US009634425B1

(12) United States Patent
Hsu et al.

(10) Patent No.: US 9,634,425 B1
(45) Date of Patent: Apr. 25, 2017

(54) WATERPROOF CONNECTOR AND ELECTRONIC DEVICE INCLUDING THE SAME

(71) Applicant: Cheng Uei Precision Industry Co., Ltd., New Taipei (TW)

(72) Inventors: Li Nien Hsu, New Taipei (TW); Chih Lin Yang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 15/215,603

(22) Filed: Jul. 21, 2016

(51) Int. Cl.
*H01R 13/40* (2006.01)
*H01R 13/52* (2006.01)
*H01R 13/405* (2006.01)

(52) U.S. Cl.
CPC ..... *H01R 13/5202* (2013.01); *H01R 13/405* (2013.01)

(58) Field of Classification Search
CPC H01R 13/52; H01R 13/5202; H01R 13/5221; H01R 13/5219; H01R 13/6593; H01R 13/648; H01R 13/6581
USPC ..... 439/587, 589, 271, 559, 607.27
See application file for complete search history.

(56) References Cited

U.S. PATENT DOCUMENTS

| | | | | |
|---|---|---|---|---|
| 7,922,535 | B1 * | 4/2011 | Jiang | H01R 13/5205 439/271 |
| 8,092,252 | B2 * | 1/2012 | Peng | H01R 12/724 439/352 |
| 8,574,001 | B2 * | 11/2013 | Lee | H01R 13/7172 200/313 |
| 9,391,391 | B2 * | 7/2016 | Chien | H01R 13/5202 |
| 9,437,957 | B2 * | 9/2016 | Lee | H01R 13/5202 |
| 9,478,998 | B1 * | 10/2016 | Lapetina | H02J 7/0042 |
| 2011/0294345 | A1 * | 12/2011 | Peng | H01R 13/5202 439/589 |
| 2014/0295689 | A1 * | 10/2014 | Zhao | H01R 12/724 439/271 |

* cited by examiner

*Primary Examiner* — Hae Moon Hyeon
(74) *Attorney, Agent, or Firm* — Lin & Associates Intellectual Property, Inc.

(57) ABSTRACT

A waterproof connector applied in an electronic device which includes a case body. The waterproof connector includes an insulating housing, a plurality of conductive terminals fastened to the insulating housing, a first shell surrounding the insulating housing together with the conductive terminals, a second shell covering the first shell and a waterproof element. A front edge of the second shell is bent outward to form a blocking portion. The waterproof element includes a first waterproof element, and a second waterproof element which is waterproof adhesive. The first waterproof element tightly loops around an outer surface of the front end of the first shell. The first waterproof element tightly abuts against an inner wall of the case body and the blocking portion. The waterproof adhesive is poured into and seals up a clearance among rear ends of the insulating housing, the conductive terminals and the first shell.

10 Claims, 8 Drawing Sheets

WATERPROOF CONNECTOR AND ELECTRONIC DEVICE INCLUDING THE SAME

BACKGROUND OF THE INVENTION

1. Field of the Invention

The present invention generally relates to a connector, and more particularly to a waterproof connector and an electronic device including the same.

2. The Related Art

Usually, a current electronic device or a transmission equipment generally includes a case body, and a connector used for transmitting data or charging. The case body opens an opening. The connector is assembled to the case body. The connector is partially exposed to the opening of the case body so as to dock with a mating connector of other electronic device or charging equipment.

However, when the electronic device or the transmission equipment is used in an outdoor, raining or high humidity environment, an electrical characteristic and a usage life of the connector is easily affected on account of moisture and liquid outside the connector permeating into the connector.

Thus, how to improve the above-mentioned problems by means of a structure design has become an important issue which is to be solved by skilled persons in the art, so a waterproof connector and an electronic device are essential to be provided, the waterproof connector and the electronic device have reasonable designs and effectively improve the above-mentioned problems.

SUMMARY OF THE INVENTION

An object of the present invention is to provide a waterproof connector applied in an electronic device which includes a case body. The waterproof connector is assembled to the case body. The waterproof connector includes an insulating housing, a plurality of conductive terminals fastened to the insulating housing, a first shell, a second shell and a waterproof element. The first shell surrounds the insulating housing together with the conductive terminals. The second shell covers the first shell. A front end of the first shell projects beyond a front edge of the second shell. The front edge of the second shell is bent outward to form a blocking portion. The waterproof element includes a first waterproof element, and a second waterproof element which is waterproof adhesive. The first waterproof element tightly loops around an outer surface of the front end of the first shell projecting beyond the front edge of the second shell. And the first waterproof element is tightly positioned between and abuts against an inner wall of the case body and the blocking portion to seal up a clearance between the outer surface of the front end of the first shell and the case body. The waterproof adhesive is poured into and seals up a clearance among rear ends of the insulating housing, the conductive terminals and the first shell.

Another object of the present invention is to provide an electronic device. The electronic device includes a case body, and a waterproof connector assembled to the case body. The case body opens a mouth longitudinally penetrating therethrough. A rear of the mouth spreads outward to form a receiving groove communicated with the mouth. A peripheral wall of a front of the mouth is defined as a ring-shaped stopping step. The waterproof connector includes an insulating housing, a plurality of conductive terminals fastened to the insulating housing, a first shell surrounding the insulating housing together with the conductive terminals, a second shell covering the first shell, and a waterproof element. A front end of the first shell projects beyond a front edge of the second shell. The front edge of the second shell is bent outward to form a blocking portion. The waterproof element includes a first waterproof element, and a second waterproof element which is waterproof adhesive. The front end of the first shell projecting beyond the front edge of the second shell is inserted into the mouth. The first waterproof element is received in the receiving groove, and the first waterproof element is tightly positioned among and abuts against an inner wall of the receiving groove, the stopping step and the blocking portion to seal up a clearance between an outer surface of the front end of the first shell and the case body. The waterproof adhesive is poured into and seals up a clearance among rear ends of the insulating housing, the conductive terminals and the first shell.

As described above, the first waterproof element tightly loops around the outer surface of the front end of the first shell projecting beyond the front edge of the second shell, the first waterproof element is tightly positioned between and abuts against the inner wall of the case body and the blocking portion to seal up the clearance between the outer surface of the front end of the first shell and the case body so as to avoid moisture and liquid outside the waterproof connector permeating into the waterproof connector from the clearance between the outer surface of the front end of the first shell and the case body, and the waterproof adhesive is poured into and seals up the clearance among the rear ends of the insulating housing, the conductive terminals and the first shell so as to avoid the moisture and liquid outside the waterproof connector permeating into the waterproof connector from the clearance among the rear ends of the insulating housing, the conductive terminals and the first shell. As a result, the waterproof connector and the electronic device have reasonable designs, the moisture and liquid outside the waterproof connector are avoided permeating into the waterproof connector to effectively ensure an electrical characteristic and a usage life of the waterproof connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
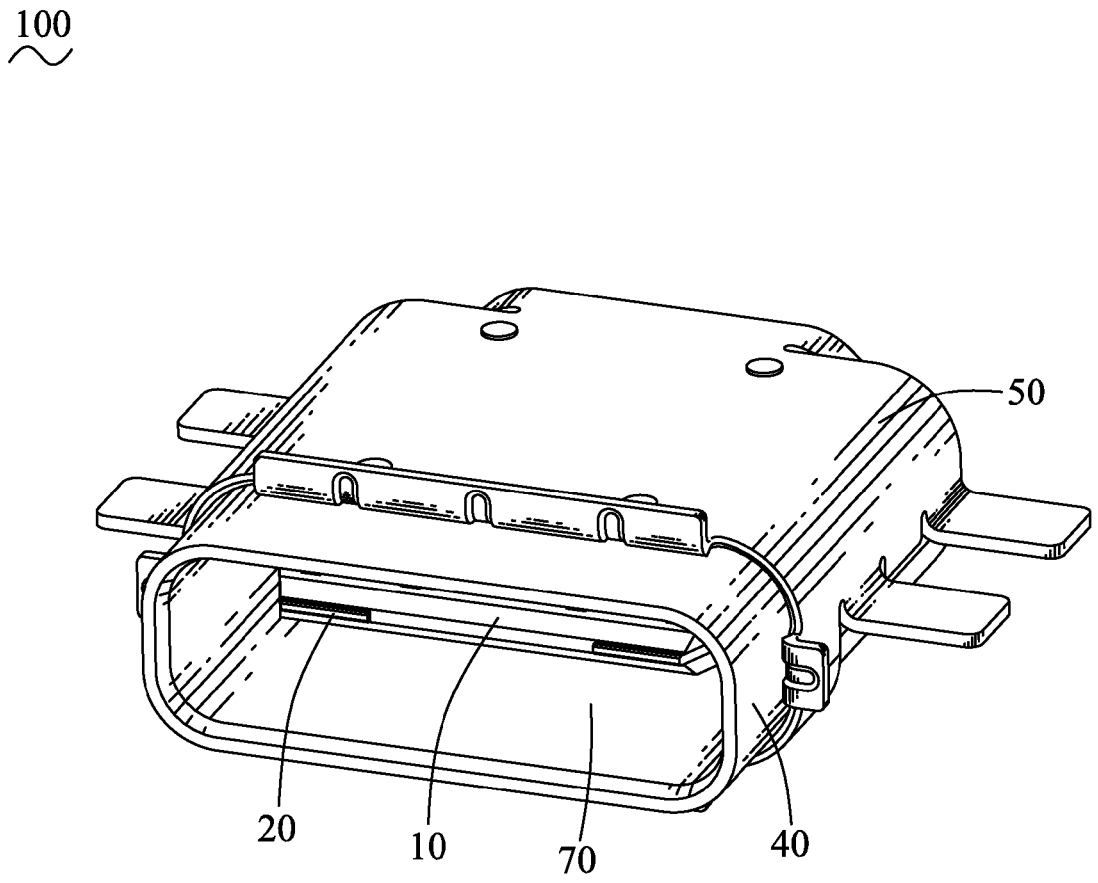
FIG. 1 is a perspective view of a waterproof connector in accordance with a preferred embodiment of the present invention.
Figure 3:
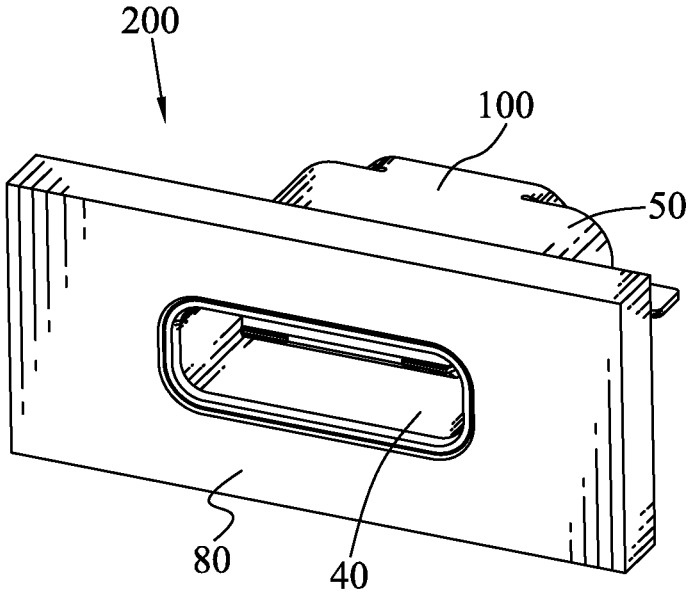
FIG. 3 is a perspective view showing the waterproof connector of FIG. 1 being assembled in a case body of an electronic device.
Figure 4:
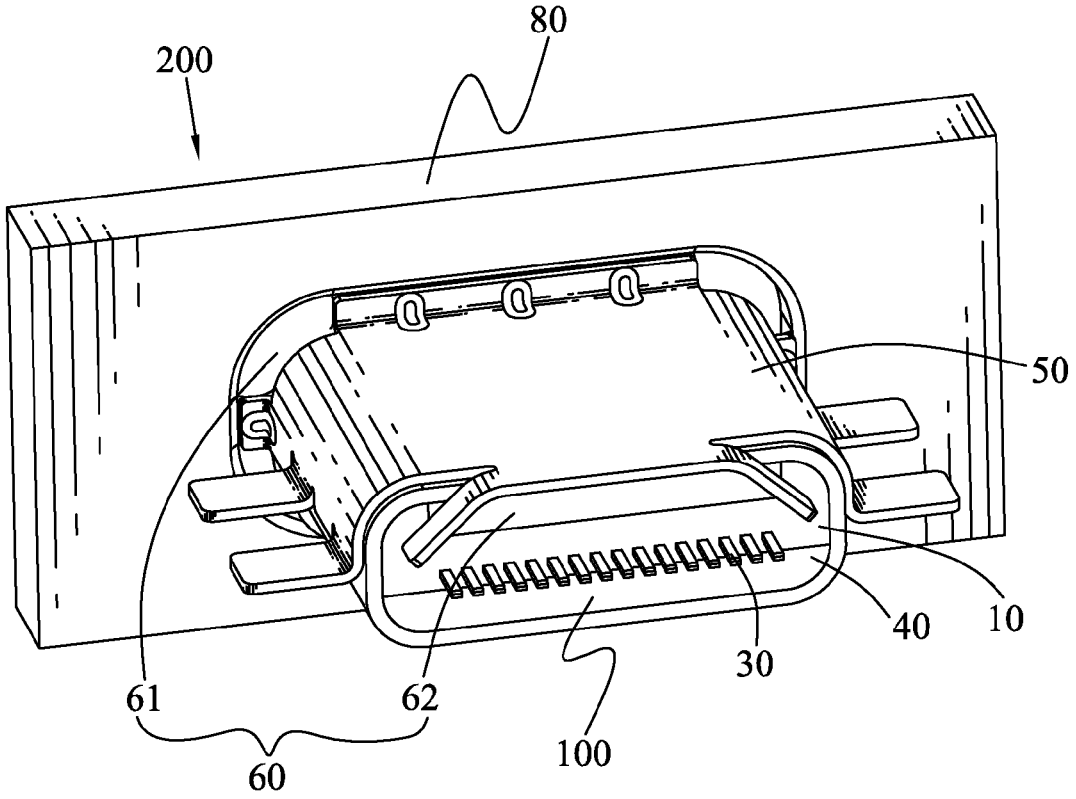
FIG. 4 is another perspective view showing the waterproof connector of FIG. 1 being assembled in the case body of the electronic device.
Figure 5:
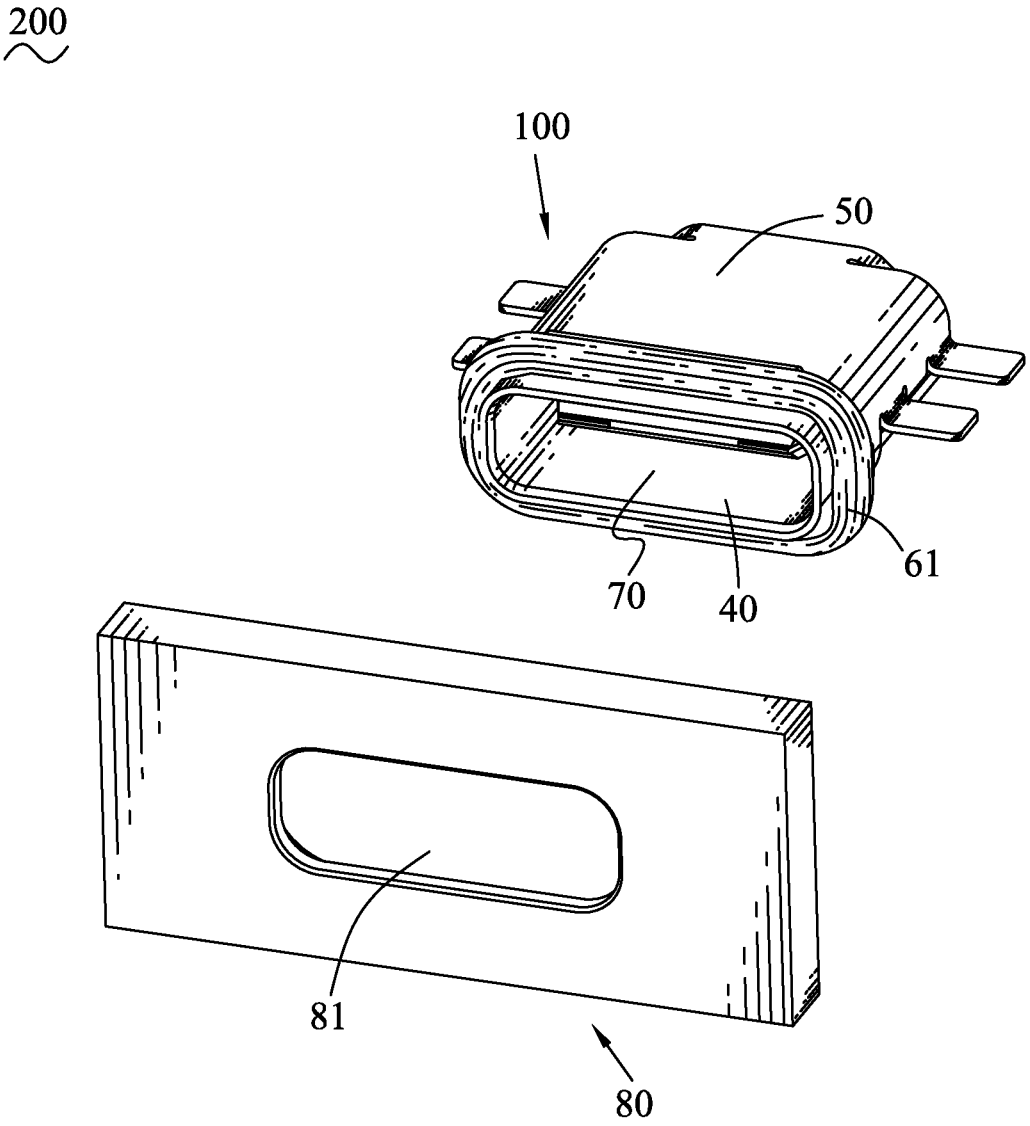
FIG. 5 is an exploded view of the waterproof connector and the case body of the electronic device of FIG. 4.
Figure 6:
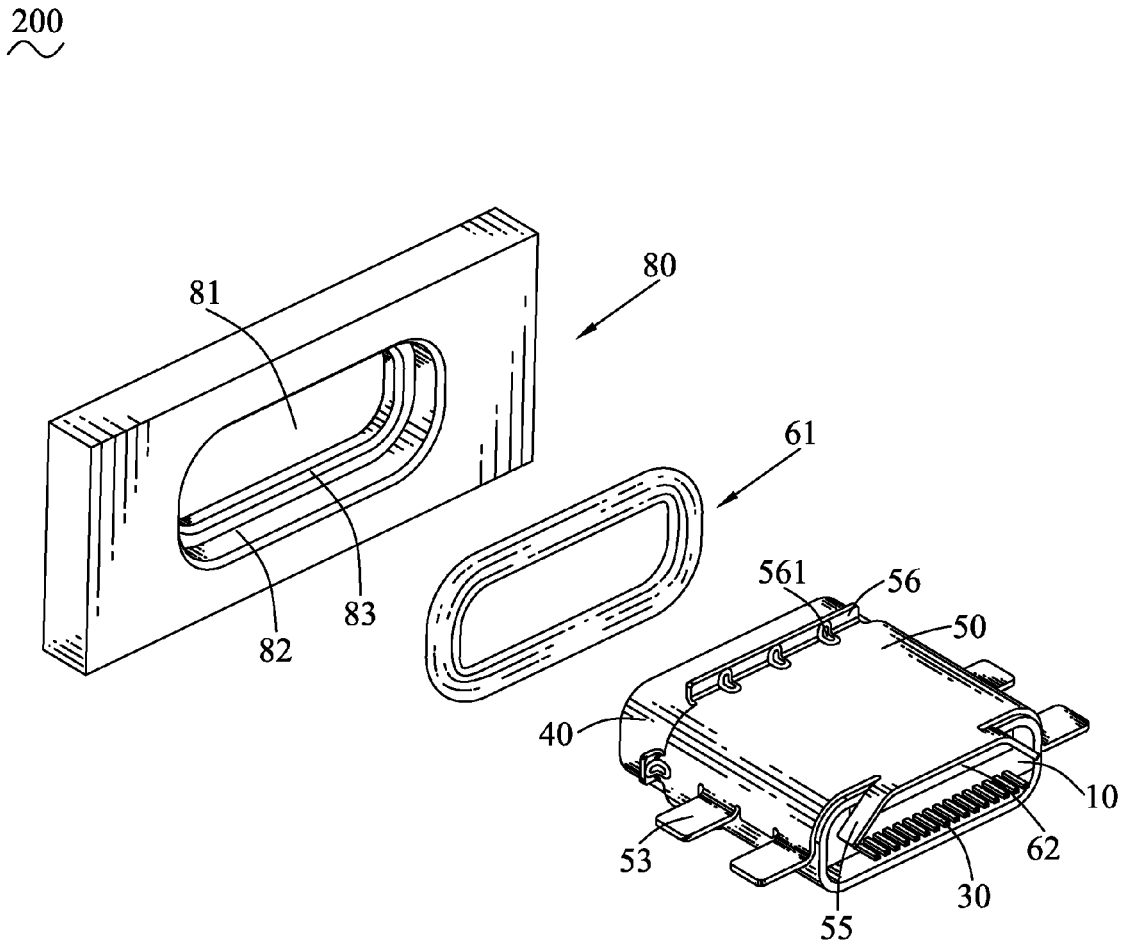
FIG. 6 is another exploded view of the waterproof connector and the case body of the electronic device of FIG. 4.
Figure 7:
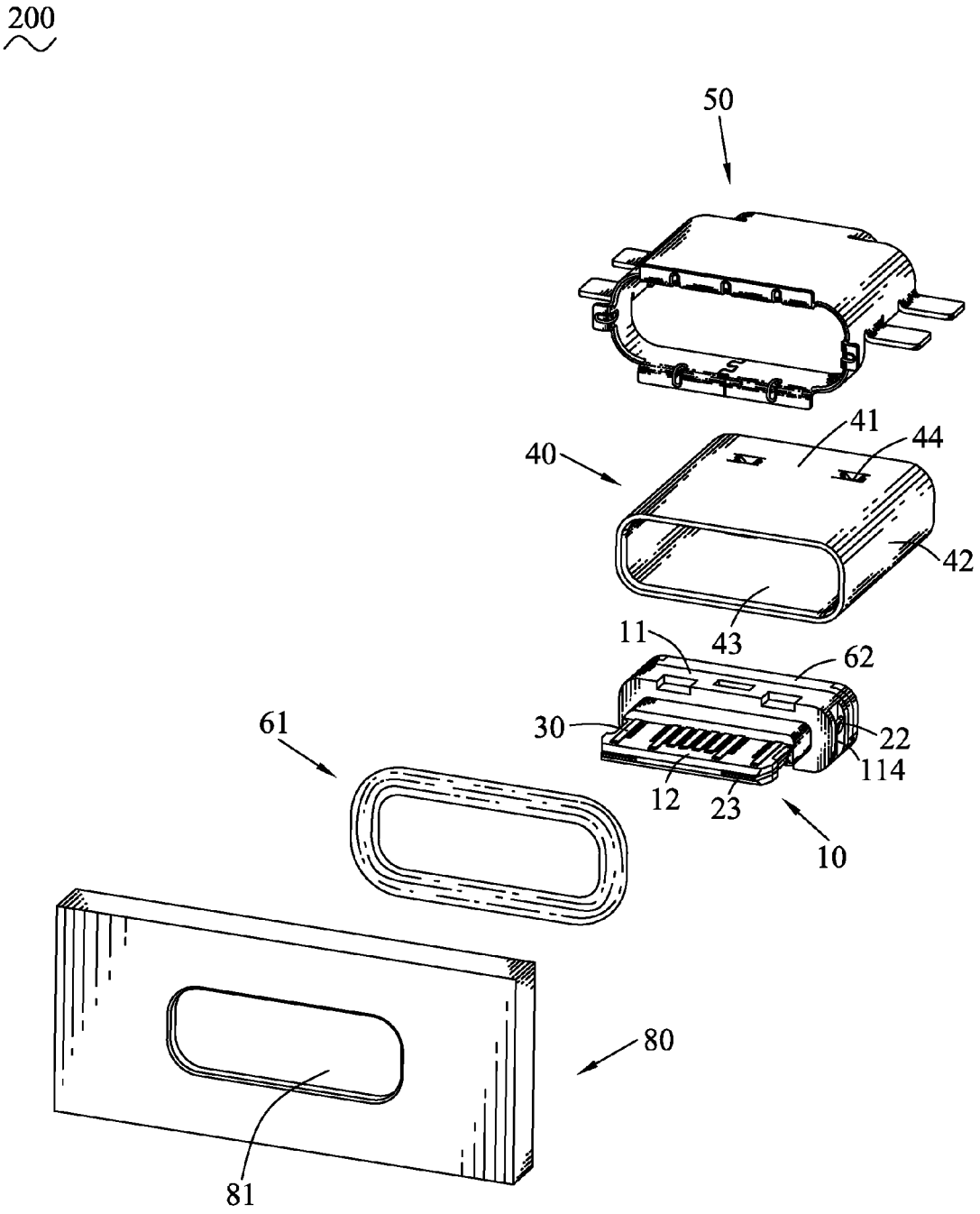
FIG. 7 is one other exploded view of the waterproof connector and the case body of the electronic device of FIG. 4.

With reference to FIG. 1, FIG. 3 and FIG. 4, a waterproof connector 100 and an electronic device 200 in accordance with a preferred embodiment of the present invention are shown. The waterproof connector 100 applied in the electronic device 200, includes an insulating housing 10, a reinforcing plate 20, a plurality of conductive terminals 30, a first shell 40, a second shell 50 and a waterproof element 60. The electronic device 200 includes a case body 80 and the waterproof connector 100 assembled to the case body 80.

Figure 2:
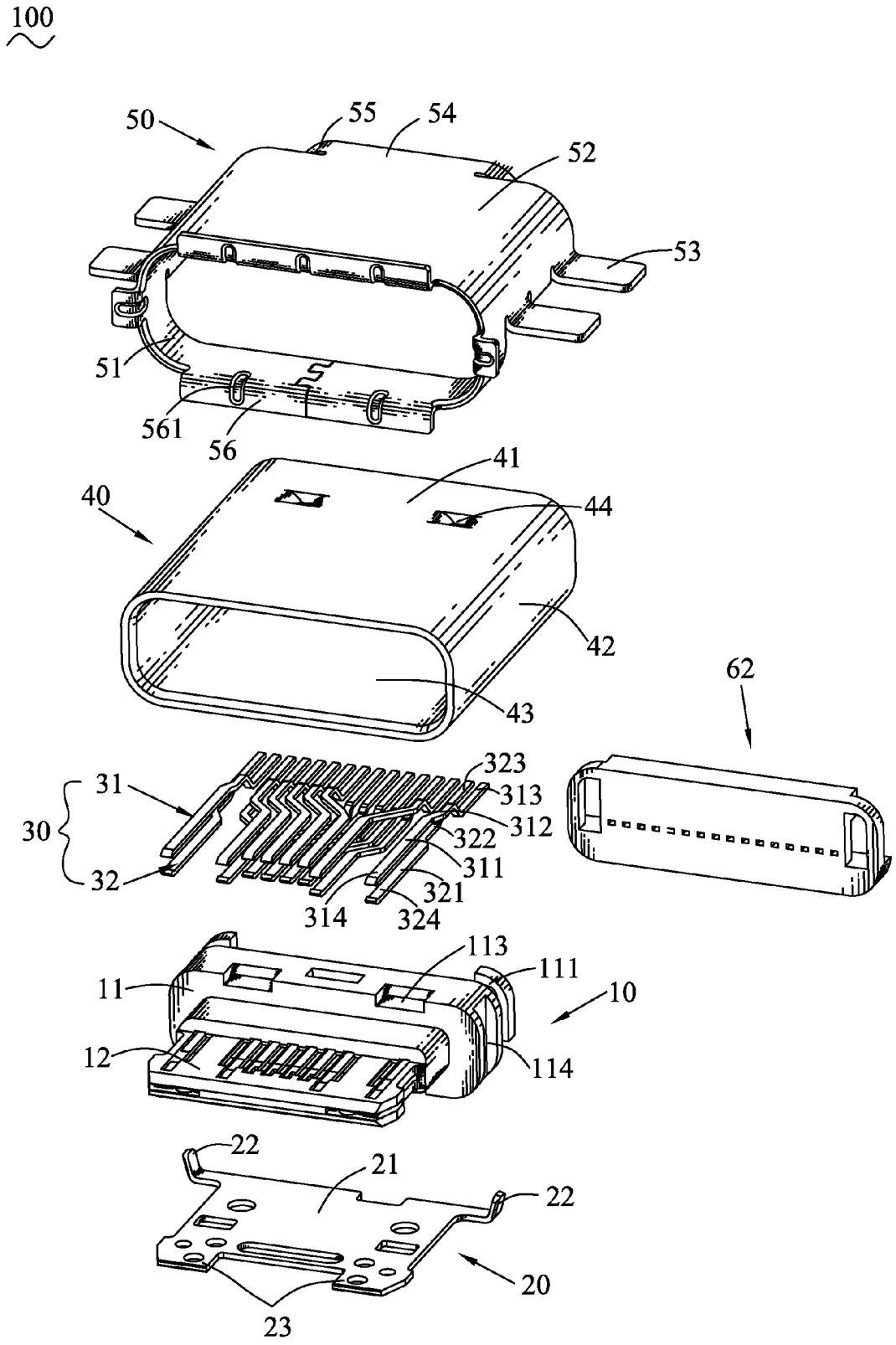
FIG. 2 is an exploded view of the waterproof connector of FIG. 1.
Figure 8:
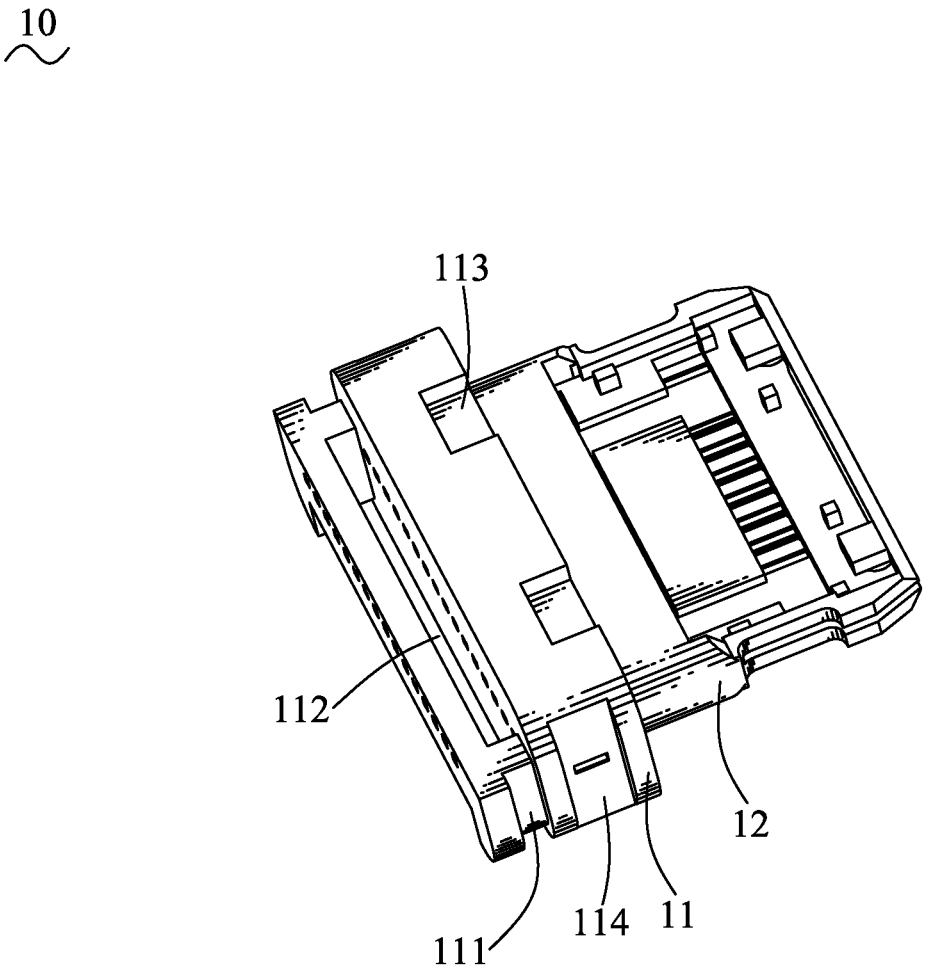
FIG. 8 is a perspective view of an insulating housing of the waterproof connector of FIG. 7.

Referring to FIG. 2 and FIG. 8, the insulating housing 10 has a base portion 11, and a tongue portion 12 protruded frontward from a front of the base portion 11. A periphery of a rear end of the base portion 11 is recessed inward to form a ring-shaped fastening slot 111. The rear end of the base portion 11 defines a penetrating slot 112 connected between a middle of a top of the fastening slot 111 and a middle of a bottom of the fastening slot 111. Several portions of a top surface and a bottom surface of the base portion 11 are recessed inward to form a plurality of buckling grooves 113. Front ends of two opposite side surfaces of the base portion 11 are recessed inward to form two fixing grooves 114.

The reinforcing plate 20 is integrally molded in a middle of the insulating housing 10. The reinforcing plate 20 has a base plate 21, two fixing plates 22 extended outward and then bent upward from rear ends of two opposite sides of the base plate 21, and two extending arms 23 extended frontward from two opposite sides of a front end of the base plate 21. The base plate 21 is integrally molded in the insulating housing 10. The two fixing plates 22 are fixed in the two fixing grooves 114. The two extending arms 23 project beyond a front surface of the tongue portion 12. When a mating connector is inserted into the waterproof connector 100, the two extending arms 23 avoids the waterproof connector 100 being damaged under a condition of a front surface of the tongue portion 12 having small foreign bodies.

The conductive terminals 30 are fastened to the insulating housing 10. The conductive terminals 30 include a plurality of first conductive terminals 31 and a plurality of second conductive terminals 32. Each of the first conductive terminals 31 has a bar-shaped first fastening portion 311, a first bending portion 312 slantwise extended rearward and sideward, then extended rearward and further slantwise bent downward and rearward from a rear end of the first fastening portion 311, a first soldering portion 313 extended rearward from a tail end of the first bending portion 312, and a first contact portion 314 extended frontward and then bent downward from a front end of the first fastening portion 311.

Each of the second conductive terminals 32 has a bar-shaped second fastening portion 321, a second bending portion 322 slantwise extended rearward and sideward, then extended rearward and further slantwise bent upward and rearward from a rear end of the second fastening portion 321, a second soldering portion 323 extended rearward from a tail end of the second bending portion 322, and a second contact portion 324 extended frontward and then bent upward from a front end of the second fastening portion 321.

The first conductive terminals 31 and the second conductive terminals 32 are integrally molded to the insulating housing 10. The first fastening portions 311 and the first contact portions 314 of the first conductive terminals 31 are integrally molded to a top surface of the tongue portion 12. The second fastening portions 321 and the second contact portions 324 of the second conductive terminals 32 are integrally molded to a bottom surface of the tongue portion 12. The first soldering portions 313 of the first conductive terminals 31 and the second soldering portions 323 of the second conductive terminals 32 are partially molded in the base portion 11 and tail ends of the first soldering portions 313 and tail ends of the second soldering portions 323 project beyond a rear surface of the base portion 11. Bottom surfaces of the first soldering portions 313 and the second soldering portions 323 are flush.

Referring to FIG. 1 and FIG. 2, the first shell 40 is of a hollow rectangular shape. The first shell 40 surrounds the insulating housing 10 together with the conductive terminals 30. The two fixing plates 22 resiliently abut against an inner surface of the first shell 40. An insertion space 70 is formed between the first shell 40 and the insulating housing 10. The first shell 40 has a top plate 41, two lateral plates 42 and a bottom plate 43. Two lateral plates 42 are connected between the top plate 41 and the bottom plate 43. Several portions of rear ends of the top plate 41 and the bottom plate 43 are punched inward to form a plurality of buckling portions 44. The buckling portions 44 are buckled in the buckling grooves 113 for preventing the first shell 40 from moving rearward with respect to the insulating housing 10. The two fixing plates 22 resiliently abut against inner surfaces of the two lateral plates 42 of the first shell 40, respectively for preventing the first shell 40 sliding. A front end of an inner peripheral wall of the first shell 40 is chamfered so as to guide the mating connector to be inserted into the first shell 40.

Referring to FIG. 1 and FIG. 2, the second shell 50 covers the first shell 40. A front end of the first shell 40 projects beyond a front edge of the second shell 50. The front edge of the second shell 50 is bent outward to form a blocking portion 56. A rear end of the second shell 50 extends inward to form a blocking arm 55. The second shell 50 has a ring-shaped sleeving portion 51, and a shielding portion 52 extended rearward from a rear end of a top of the sleeving portion 51. Several portions of two opposite sides of the shielding portion 52 extend downward and then are bent outward to form a plurality of soldering feet 53. A middle of a rear end of the shielding portion 52 extends rearward to form a connecting portion 54. Two opposite sides of the connecting portion 54 slantwise extend outward and downward to form two blocking arms 55. The sleeving portion 51 sleeves around an outer surface of the front end of the first shell 40. The two blocking arms 55 block against rear ends of the insulating housing 10 and the first shell 40 so as to prevent the insulating housing 10 and the first shell 40 from moving. A top, a bottom and two sides of the front edge of the second shell 50 are bent outward to form four blocking portions 56. A portion of each of the four blocking portions 56 is punched outward to form a protruding rib 561 for enforcing a structure strength.

Referring to FIG. 2 to FIG. 8, the waterproof element 60 includes a frame-shaped first waterproof element 61, and a second waterproof element 62 which is waterproof adhesive. The first waterproof element 61 is disposed between the first shell 40 and the case body 80. The second waterproof element 62 is disposed in a clearance among the rear end of the insulating housing 10, rear ends of the conductive terminals 30 and the rear end of the first shell 40. The first waterproof element 61 tightly loops around the outer surface of the front end of the first shell 40 projecting beyond the front edge of the second shell 50. The first waterproof element 61 is tightly positioned between and abuts against an inner wall of the case body 80 and the blocking portion 56 to seal up a clearance between the outer surface of the front end of the first shell 40 and the case body 80. The waterproof adhesive is poured into and seals up the clearance among the rear ends of the insulating housing 10, the conductive terminals 30 and the first shell 40.

Specifically, the case body 80 opens a mouth 81 longitudinally penetrating therethrough. A rear of the mouth 81 spreads outward to form a receiving groove 82 matched with the first waterproof element 61, so a peripheral wall of a front of the mouth 81 is defined as a ring-shaped stopping step 83. The receiving groove 82 is communicated with the mouth 81. The front end of the first shell 40 projecting beyond the front edge of the second shell 50 is inserted into the mouth 81. The first waterproof element 61 is received in the receiving groove 82, and the first waterproof element 61 is tightly positioned among and abuts against an inner wall of the receiving groove 82, the stopping step 83 and the blocking portion 56 to seal up the clearance between the outer surface of the front end of the first shell 40 and the case body 80. The waterproof adhesive is poured into and seals up the clearance among the rear ends of the insulating housing 10, the conductive terminals 30 and the first shell 40.

A rear end of the first waterproof element 61 abuts against the blocking portions 56 for preventing the first waterproof element 61 from moving rearward, so moisture and liquid outside the waterproof connector 100 are avoided permeating into the clearance between the first shell 40 and the case body 80. The waterproof adhesive is poured into the fastening slot 111 and the penetrating slot 112 through the rear end of the first shell 40 to form the second waterproof element 62, so that the clearance among the rear ends of the insulating housing 10, the conductive terminals 30 and the first shell 40 is sealed up by the second waterproof element 62. So the moisture and liquid outside the waterproof connector 100 are avoided permeating into the clearance among the insulating housing 10, the conductive terminals 30 and the first shell 40.

The waterproof connector 100 is mounted to a circuit board (not shown). The bottom surfaces of the first soldering portions 313 and the second soldering portions 323 are capable of being soldered to the circuit board directly. The soldering feet 53 are capable of being soldered to the circuit board directly. The soldering feet 53 are capable of being inserted into the circuit board.

As described above, the first waterproof element 61 tightly loops around the outer surface of the front end of the first shell 40 projecting beyond the front edge of the second shell 50, the first waterproof element 61 is tightly positioned between and abuts against the inner wall of the case body 80 and the blocking portion 56 to seal up the clearance between the outer surface of the front end of the first shell 40 and the case body 80 so as to avoid the moisture and liquid outside the waterproof connector 100 permeating into the waterproof connector 100 from the clearance between the outer surface of the front end of the first shell 40 and the case body 80, and the waterproof adhesive is poured into and seals up the clearance among the rear ends of the insulating housing 10, the conductive terminals 30 and the first shell 40 so as to avoid the moisture and liquid outside the waterproof connector 100 permeating into the waterproof connector 100 from the clearance among the rear ends of the insulating housing 10, the conductive terminals 30 and the first shell 40. As a result, the waterproof connector 100 and the electronic device 200 have reasonable designs, the moisture and liquid outside the waterproof connector 100 are avoided permeating into the waterproof connector 100 to effectively ensure an electrical characteristic and a usage life of the waterproof connector 100.

What is claimed is:

1. A waterproof connector applied in an electronic device which includes a case body, the waterproof connector being assembled to the case body, the waterproof connector comprising:

an insulating housing;

a plurality of conductive terminals fastened to the insulating housing;

a first shell surrounding the insulating housing together with the conductive terminals;

a second shell covering the first shell, a front end of the first shell projecting beyond a front edge of the second shell, the front edge of the second shell being bent outward to form a blocking portion; and a waterproof element including a first waterproof element, and a second waterproof element which is waterproof adhesive, the first waterproof element tightly looping around an outer surface of the front end of the first shell projecting beyond the front edge of the second shell, and the first waterproof element being tightly positioned between and abutting against an inner wall of the case body and the blocking portion to seal up a clearance between the outer surface of the front end of the first shell and the case body, the waterproof adhesive being poured into and sealing up a clearance among rear ends of the insulating housing, the conductive terminals and the first shell.

2. The waterproof connector as claimed in claim 1, wherein the insulating housing has a base portion, and a tongue portion protruded frontward from a front of the base portion, a periphery of a rear end of the base portion is recessed inward to form a ring-shaped fastening slot, the rear end of the base portion defines a penetrating slot connected between a middle of a top of the fastening slot and a middle of a bottom of the fastening slot, the waterproof adhesive is poured into the fastening slot and the penetrating slot to form the second waterproof element, the clearance among the rear ends of the insulating housing, the conductive terminals and the first shell is sealed up by the second waterproof element.

3. The waterproof connector as claimed in claim 2, further comprising a reinforcing plate, the reinforcing plate having a base plate, two fixing plates extended outward and then bent upward from rear ends of two opposite sides of the base plate, and two extending arms extended frontward from two opposite sides of a front end of the base plate, the base plate being integrally molded in the insulating housing, front ends of two opposite side surfaces of the base portion being recessed inward to form two fixing grooves, the two fixing plates being fixed in the two fixing grooves and resiliently abutting against an inner surface of the first shell, the two extending arms projecting beyond a front surface of the tongue portion.

4. The waterproof connector as claimed in claim 2, wherein several portions of a top surface and a bottom surface of the base portion are recessed inward to form a plurality of buckling grooves, the first shell has a top plate and a bottom plate, several portions of rear ends of the top plate and the bottom plate are punched inward to form a plurality of buckling portions, the buckling portions are buckled in the buckling grooves.

5. The waterproof connector as claimed in claim 2, wherein the conductive terminals include a plurality of first conductive terminals, each of the first conductive terminals has a bar-shaped first fastening portion, a first bending portion slantwise extended rearward and sideward, then extended rearward and further slantwise bent downward and rearward from a rear end of the first fastening portion, a first soldering portion extended rearward from a tail end of the first bending portion, and a first contact portion extended frontward and then bent downward from a front end of the first fastening portion, the first fastening portions and the first contact portions of the first conductive terminals are integrally molded to a top surface of the tongue portion, the first soldering portions of the first conductive terminals are partially molded in the base portion and tail ends of the first soldering portions project beyond a rear surface of the base portion.

6. The waterproof connector as claimed in claim 5, wherein the conductive terminals include a plurality of second conductive terminals, each of the second conductive terminals has a bar-shaped second fastening portion, a second bending portion slantwise extended rearward and sideward, then extended rearward and further slantwise bent upward and rearward from a rear end of the second fastening portion, a second soldering portion extended rearward from a tail end of the second bending portion, and a second contact portion extended frontward and then bent upward from a front end of the second fastening portion, the second fastening portions and the second contact portions of the second conductive terminals are integrally molded to a bottom surface of the tongue portion, the second soldering portions of the second conductive terminals are partially molded in the base portion and tail ends of the second soldering portions project beyond the rear surface of the base portion.

7. The waterproof connector as claimed in claim 6, wherein bottom surfaces of the first soldering portions and the second soldering portions are flush.

8. The waterproof connector as claimed in claim 1, wherein the second shell has a ring-shaped sleeving portion, and a shielding portion extended rearward from a rear end of a top of the sleeving portion, several portions of two opposite sides of the shielding portion extend downward and then are bent outward to form a plurality of soldering feet, a middle of a rear end of the shielding portion extends rearward to form a connecting portion, two opposite sides of the connecting portion slantwise extend outward and downward to form two blocking arms, the sleeving portion sleeves around the outer surface of the front end of the first shell, the two blocking arms block against the rear ends of the insulating housing and the first shell.

9. The waterproof connector as claimed in claim 8, wherein a top, a bottom and two sides of the front edge of the second shell are bent outward to form four blocking portions, a portion of each of the four blocking portions is punched outward to form a protruding rib, a rear end of the first waterproof element abuts against the blocking portions.

10. An electronic device, comprising:

a case body opening a mouth longitudinally penetrating therethrough, a rear of the mouth spreading outward to form a receiving groove communicated with the mouth, a peripheral wall of a front of the mouth being defined as a ring-shaped stopping step; and a waterproof connector assembled to the case body, the waterproof connector including:

an insulating housing, a plurality of conductive terminals fastened to the insulating housing, a first shell surrounding the insulating housing together with the conductive terminals, a second shell covering the first shell, a front end of the first shell projecting beyond a front edge of the second shell, the front edge of the second shell being bent outward to form a blocking portion, and a waterproof element including a first waterproof element, and a second waterproof element which is waterproof adhesive, the front end of the first shell projecting beyond the front edge of the second shell being inserted into the mouth, the first waterproof element being received in the receiving groove, and the first waterproof element being tightly positioned among and abutting against an inner wall of the receiving groove, the stopping step and the blocking portion to seal up a clearance between an outer surface of the front end of the first shell and the case body, the waterproof adhesive being poured into and sealing up a clearance among rear ends of the insulating housing, the conductive terminals and the first shell.

* * * * *